US009702165B2

(12) United States Patent
Feirer et al.

(10) Patent No.: US 9,702,165 B2
(45) Date of Patent: Jul. 11, 2017

(54) SENSOR SYSTEM FOR A LOCKING SYSTEM AND METHOD FOR DETECTING TAMPERINGS AT A LOCKING SYSTEM

(71) Applicant: Robert Bosch GmbH, Stuttgart (DE)

(72) Inventors: Michael Feirer, Filderstadt (DE); Philipp Stark, Stuttgart (DE); Frank Schindler, Reutlingen (DE); Julian Bartholomeyczik, Reutlingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 102 days.

(21) Appl. No.: 14/778,479

(22) PCT Filed: Jan. 31, 2014

(86) PCT No.: PCT/EP2014/051874

§ 371 (c)(1),
(2) Date: Sep. 18, 2015

(87) PCT Pub. No.: WO2014/154381

PCT Pub. Date: Oct. 2, 2014

(65) Prior Publication Data

US 2016/0290009 A1 Oct. 6, 2016

(30) Foreign Application Priority Data

Mar. 26, 2013 (DE) ..... 10 2013 205 368

(51) Int. Cl.
*E05B 45/10* (2006.01)
*G08B 13/06* (2006.01)
(Continued)

(52) U.S. Cl.
CPC ..... *E05B 45/10* (2013.01); *G08B 13/06* (2013.01); *G08B 13/08* (2013.01); *E05B 2045/063* (2013.01); *E05B 2045/065* (2013.01)

(58) Field of Classification Search
CPC ..... G08B 13/08; G08B 13/06; G08B 29/046; E05B 2045/063; E05B 2045/065
See application file for complete search history.

(56) References Cited

U.S. PATENT DOCUMENTS 3,475,934 A 11/1969 Reisner
4,186,578 A 2/1980 Sommer
(Continued)

FOREIGN PATENT DOCUMENTS

CN 1200187 A 11/1998
CN 2330023 Y 7/1999
(Continued)

OTHER PUBLICATIONS

International Search Report for PCT/EP2014/051874, dated Aug. 19, 2014.

*Primary Examiner* — Hongmin Fan
(74) *Attorney, Agent, or Firm* — Norton Rose Fulbright US LLP; Gerard Messina

(57) ABSTRACT

A sensor system for a locking system of a door includes: an acceleration sensor which is designed to detect movements of the door in at least two dimensions and to record a time-resolved acceleration profile; a magnetic field sensor which is designed to detect a magnetic field in the area of the locking system, to detect changes of the magnetic field and to record a time-resolved magnetic field change profile; and a control device which is coupled to the acceleration sensor and to the magnetic field sensor and which is designed to correlate the acceleration profile to the magnetic field change profile, to compare the profile correlation to a predetermined correlation signature, and to output an alarm signal if the profile correlation matches the correlation signature.

8 Claims, 2 Drawing Sheets

(51) Int. Cl.

| | |
|---|---|
| ***G08B 13/08*** | (2006.01) |
| *E05B 45/06* | (2006.01) |

(56) References Cited

U.S. PATENT DOCUMENTS

| | | | |
|---|---|---|---|
| 5,567,099 | A | 10/1996 | DaFoe |
| 6,854,307 | B2 | 2/2005 | Mazarello |
| 6,963,281 | B2 | 11/2005 | Buckley |
| 7,397,341 | B2 | 7/2008 | Bhat et al. |
| 2009/0102649 | A1 | 4/2009 | Diener et al. |
| 2011/0057788 | A1 | 3/2011 | Talkington et al. |

FOREIGN PATENT DOCUMENTS

| | | | |
|---|---|---|---|
| CN | 101586419 | A | 11/2009 |
| DE | 10 2011 013730 | | 9/2012 |
| EP | 198 1010 | | 10/2008 |

(a)

(b)

SENSOR SYSTEM FOR A LOCKING SYSTEM AND METHOD FOR DETECTING TAMPERINGS AT A LOCKING SYSTEM

BACKGROUND OF THE INVENTION

1. Field of the Invention

The present invention relates to a sensor system for a locking system as well as to a method for detecting tampering at a locking system, in particular in locking systems of doors or gates, for example, at entrance doors to buildings or apartment doors situated within buildings.

2. Description of the Related Art

The term "lock picking" refers to the damage-free opening of cylinder locks of a lock with the aid of a specifically adapted break-in tool. The possibility of opening a lock at all by lock picking essentially results from inaccuracies during manufacturing of cylinder locks which are mechanically either unpreventable or preventable only at high costs. For this reason, locking systems including cylinder pins have pin openings which are offset from one another. During lock picking, the cylinder lock may be subjected to pretension in such a way that only one of the pins is clamped. By correspondingly sensitive displacement, this pin may subsequently be brought into an unlocked position. Once the unlocked position is reached, the cylinder core may be rotated further by the minimal offset so that the next pin may be subjected to pretension. Using this iterative process, the cylinder core may be unlocked without a key being required and without the lock being damaged.

This break-in method is particularly unpleasant for victims, since providing proof of an unauthorized entry is either impossible or possible only with an examination by an expert.

Different approaches for proving break-in attempts by lock picking are known from the related art. U.S. Pat. No. 5,567,099 A describes a system which is able to detect a break-in using motion detection with the aid of light sensors and trigger an alarm. U.S. Pat. No. 6,963,281 A describes a system including multiple magnetic contact switches which are disconnected during a break-in attempt so that an alarm may accordingly be triggered. U.S. Pat. No. 3,475,934 A and U.S. Pat. No. 6,854,307 A each describe additional inserts into a key hole which may thereby be locked. U.S. Pat. No. 4,186,578 A describes a detection method with which the insertion of electrically conductive material into a key hole may be detected. Published European patent application document EP 1 981 010 A2 describes a system which may detect a break-in by measuring energy during the break-in attempt and comparing the measured energy to a stored energy signature. Finally, U.S. Pat. No. 7,397,341 A1 describes a combination of an acoustic sensor and a vibration sensor, whose detected signals are compared to reference signals in order to detect the signature of a lock-picking attack.

However, there is a need for approaches for the detection of break-in attempts, in particular by lock picking, which may differentiate more reliably and dependably between actual break-in attempts and other activities in the door area or justified locking attempts taking more time.

BRIEF SUMMARY OF THE INVENTION

The present invention therefore provides according to one aspect a sensor system for a locking system of a door including an acceleration sensor which is designed to detect movements of the door in at least two dimensions, a magnetic field sensor which is designed to detect a magnetic field in the area of the locking system and to detect changes in the magnetic field, and a control device which is coupled to the acceleration sensor and to the magnetic field sensor and which is designed to record a time-resolved acceleration profile based on the detected movements of the door, to record a time-resolved magnetic field change profile from the detected changes of the magnetic field, to correlate the acceleration profile to the magnetic field change profile, to compare the profile correlation to a predeterminable correlation signature, and to output an alarm signal if the profile correlation matches the correlation signature.

According to another aspect, the present invention provides a method for detecting tamperings at a locking system of a door including the steps of the time-resolved detection of movements of the door in at least two dimensions, the recording of a time-resolved acceleration profile based on the detected movements, the detection of a magnetic field in the area of the locking system, the time-resolved detection of changes of the magnetic field, the recording of a time-resolved magnetic field change profile, the correlation of the acceleration profile with the magnetic field change profile, the comparison of the profile correlation to a predeterminable correlation signature, and the output of an alarm signal if the profile correlation matches the correlation signature.

It is an idea of the present invention to carry out a plausibility check of different sensor signals using an intelligent data analysis in order to significantly improve the detection behavior compared to actual break-in attempts. For this purpose, a motion profile of the door is recorded and correlated with respect to time to a magnetic field change profile in the area of the locking system of the door.

Acceleration sensors generally record a large spectrum of external mechanical influences on the door, for example, acoustic vibrations due to noise, sirens or construction work. In order to decrease the false positive rate of an acceleration sensor, the magnetic field sensor may detect the approach of metallic objects and differentiate between keys and lock picking tools. By correlating the data of the magnetic field sensor with the data of the acceleration sensor, a signature of a break-in attempt may be greatly improved so that alarm signals are only output when an actual undesirable and unauthorized tampering at the door takes place with a lock picking attempt.

A significant advantage is that the correlation and the data detection is very simple and resource-conserving since only little characteristic data of the sensor signals need to be compared.

In addition, the combination of acceleration sensor and magnetic field sensor is significantly less susceptible to errors since the measuring area of the magnetic field sensor is settable to being limited to a close proximity around the locking system. In addition, it is not necessary to equip the sensor system with an opening or with an entry, for example, for sound waves or light incidence, so that the system may also be installed inside the door.

The manufacturing costs for acceleration sensors and magnetic field sensors are generally very low, in particular since the resolution of both sensors does not necessarily have to be particularly high, since the high resolution of the sensor system as a whole may be achieved with the correlation of the sensor signals. The sensors may, for example, be standardized components which are manufactured in large quantities at low cost, for example, for mobile phones or smart phones.

In addition, the sensor combination of acceleration sensor and magnetic field sensor may also differentiate between break-in attempts without opening of the door and break-in attempts where an actual opening of the door takes place. In this way, different alarm levels may be set which may influence the type of output of the alarm signals.

According to one specific embodiment of the sensor system according to the present invention, the control device may include a micro-controller or a micro-processor. With the aid of such a control device, a smart signal data analysis may take place, which may transfer the results of the evaluation to a reporting facility, if necessary.

According to another specific embodiment of the sensor system according to the present invention, the control device may have a memory area which is designed to store one or multiple predeterminable correlation signature(s). In this way it is possible to calibrate the sensor system to the door or to the locking system in or at which the sensor system is used.

According to another specific embodiment of the sensor system according to the present invention, the sensor system may also include a signal output device which is coupled to the control device. This signal output device may advantageously be pre-configured to program a particular alarm behavior when detecting a break-in attempt.

According to another specific embodiment of the sensor system according to the present invention, the signal output device may be designed to output the alarm signal via an output interface of the sensor system to an alarm transmitter. This enables the connection of the sensor system, for example, to an in-house alarm system or to any other alarm transmitter situated in the area of the door.

According to an alternative specific embodiment of the sensor system according to the present invention, the signal output device may be designed to output the alarm signal via wireless communication to an alarm transmitter. This enables, for example, the notification of mobile terminals via cellular network or the alarming of security staff, for example, of private security agencies or of the police via radio.

According to a specific embodiment of the present invention, a door is provided including a locking system, and a sensor system according to the present invention, which is situated in the internal area of the door and which is designed to generate a magnetic field in an external area of the door and to output an alarm signal in the case of an unauthorized attempt at opening the locking system.

Additional features and advantages of specific embodiments of the present invention result from the following description with reference to the appended drawings.

DETAILED DESCRIPTION OF THE INVENTION

Doors within the sense of the present invention include all devices for the reversible locking of openings in walls, brickwork or passages which enable a separation of inside areas from outside areas with respect to the structural measures in which the openings are contained, and thereby enable a selective passage or entry through the openings. Doors may be gates, portals, skylights, barriers or fences as well as windows or other passage barriers to be opened. Within the sense of the present invention, doors may include all types of locking mechanisms, for example, swing doors, folding doors, sliding doors, or other door types.

Locking systems within the sense of the present invention include all locking systems which serve to allow persons who have and use a legitimate access key to open a barrier equipped with the locking system and to deny the opening to other persons. Locking systems may in particular include within the sense of the present invention, for example, pin tumbler locks, cylinder locks, warded locks, disk tumbler locks, Bramah locks or similar lock types.

Figure 1:
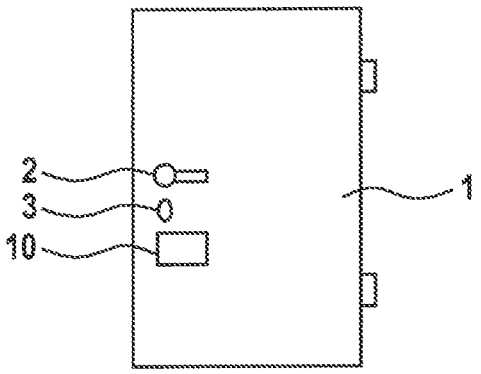
FIG. 1 shows a schematic representation of a door including a locking system and a sensor system according to a specific embodiment of the present invention.
Figure 1:
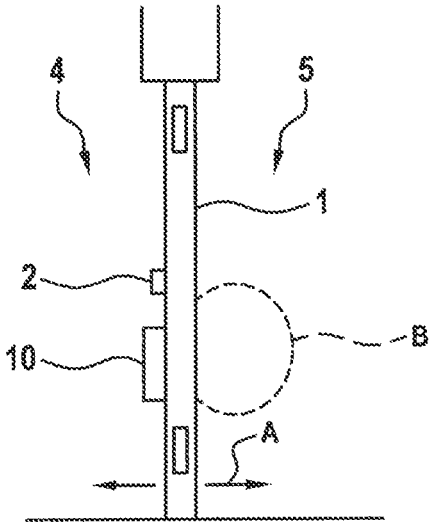

FIG. 1 shows a door 1 including a locking system 3 and a sensor system 10. View (a) shows the perspective of door 1 from the inside, while view (b) shows the perspective of the door in a side view. Door 1 may, for example, be an apartment or front door which includes a door knob 2 or a door handle 2. Below door handle 2, a locking system 3, for example, a cylinder lock, may be situated which may be opened using a matching key by inserting it into a key hole and the corresponding rotation in order to gain access through door 1. In the example of FIG. 1, door 1 is a swing door which is swiveled around hinges.

Sensor system 10 may be situated below locking system 3. Sensor system 10 includes a magnetic field sensor, which detects a magnetic field in an area which extends on the other side of door 1. An exemplary extension area B is shown in view (b), sensor system 10 being situated at the inside 4 of door 1, for example, inside the apartment, and detected magnetic field B extends in outside area 5 of door 1. The extension area of magnetic field B, which is detected, may be from a few centimeters to approximately one meter around the magnetic field sensor. Due to overlaps by the terrestrial magnetic field, magnetic fields of the electronics of the sensor system and/or magnetic fields of other components, there is usually always a magnetic field in the area of the locking system, which may be detected by the magnetic field sensor. However, not the absolute size of the magnetic field but the changes of the magnetic field over time are of importance.

Sensor system 10 furthermore includes an acceleration sensor, which detects accelerations or displacements A of door 1 in at least two dimensions. These may be accelerations or displacements A along the swing direction to open door 1, however, raising and lowering of door 1 or lateral movements along the extension area of door 1 may also be detected.

When a person approaches who attempts to gain unauthorized access through door 1, this will take place using metal tools in the case of a lock picking attempt. When the tool comes into the proximity of locking system 3 during this process, magnetic field B changes so that the magnetic field sensor detects this change and may record it. With the additionally occurring characteristic movements of door 1 during a lock picking attempt, which may be recorded by the acceleration sensor, a break-in or break-in attempt may be detected through a correlated analysis of the signals of the acceleration sensor and the magnetic field sensor.

In addition, a rotation rate sensor (not shown) may be installed in sensor system 10 so that the detection of the opening angle for a swing door 1 may be improved.

Figure 2:
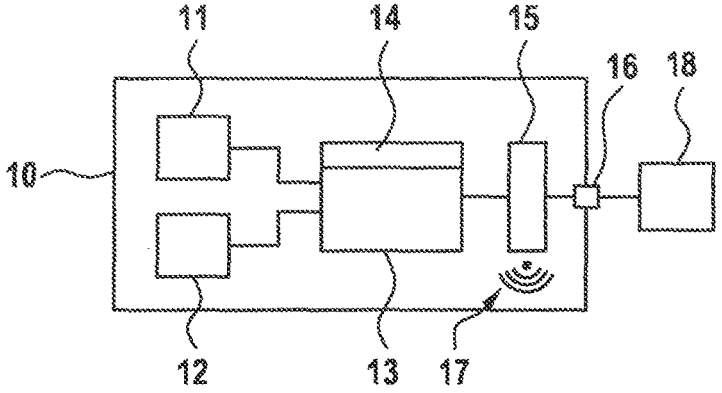
FIG. 2 shows a schematic representation of a specific embodiment of a sensor system for a locking system according to another specific embodiment of the present invention.

FIG. 2 shows a schematic representation of one specific embodiment of a sensor system 10 for a locking system, for example, for locking system 3 in FIG. 1. Sensor system 10 may, for example, be situated at a door 1 or be installed inside a door 1, for example, in door 1 in FIG. 1.

The sensor system includes an acceleration sensor 11 which is designed to detect movements of door 1 in at least two dimensions. Furthermore, the sensor system includes a magnetic field sensor 12 which is designed to generate a magnetic field B in the area of locking system 3 and to detect changes of magnetic field B. Acceleration sensor 11 and magnetic field sensor 12 are coupled to control device 13. Control device 13 is designed to record a time-resolved acceleration profile from the detected movements of door 1 and to record a time-resolved magnetic field change profile from the detected changes of magnetic field B. These two profiles may be correlated by control device 13 so that a comparison of the profile correlation to a predeterminable correlation signature may be carried out in order to output an alarm signal, if there is a match between the profile correlation and the correlation signature.

Control device 13 may, for example, include a microcontroller or a micro-processor which has a memory area 14 in which one or multiple predeterminable correlation signature(s) may be stored. The correlation signatures may be created, for example, by empirical field tests using lock picking attacks. However, it is also possible to carry out a calibration of sensor system 10 during installation in door 1 or installation at door 1 which takes the respective local circumstances of the surroundings of door 1 into account. From time to time, a re-calibration of sensor system 10 may take place if necessary; the correlation signatures may be overwritten or updated. Control device 13 may furthermore operate one of sensors 11 and 12 as a constantly detecting sensor, while the other sensor of the two sensors 11 and 12 is only switched on or activated when the constantly detecting sensor detects a signal pattern which matches a break-in attempt by lock picking. The sensor of the two sensors which is switched on may then be used for a plausibility check of this signal pattern. This may reduce the power consumption of sensor system 10. Alternatively, the two sensors 11 and 12 may also be kept in constant operation, for example, when a more reliable surveillance is desired.

Sensor system 10 may furthermore include a signal output device 15 which is coupled to control device 13 and which outputs the alarm signal via an output interface 16 of sensor system 10 to an alarm transmitter 18. For example, the alarm transmitter may include an optical or acoustic transmitter device, for example, an alarm system, a siren, an LED or a similar device. Alternatively or in addition, signal output device 15 may be designed to output the alarm signal via wireless communication, indicated by reference numeral 17, to an alarm transmitter 18 or to another device. For example, a user of sensor system 10 may be informed via app, via text message or via telephone call on their mobile terminal equipment of a detected break-in attempt. Furthermore, an alarm may be transmitted to a security company or to the police via wireless communication.

Figure 3:
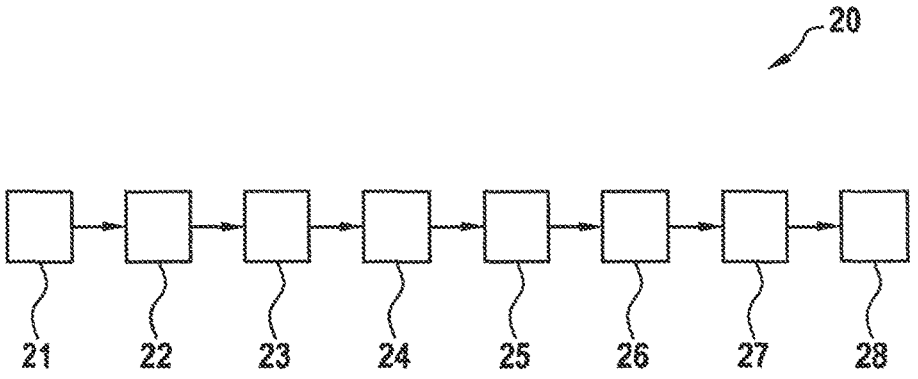
FIG. 3 shows a schematic representation of a method for detecting tamperings at a locking system according to an additional specific embodiment of the present invention.

FIG. 3 shows a schematic representation of an exemplary method 20 for detecting tamperings or a break-in attempts by lock picking at a locking system of a door. Method 20 may, for example, be used for the surveillance of locking system 3 in FIG. 1 by sensor system 10 in FIG. 2.

In a first step 21, a time-resolved detection of movements of the door may take place in at least two dimensions. In step 22 a time-resolved acceleration profile based on the detected movements may be created. In a similar manner, a magnetic field may be detected in the area of the locking system in step 23 so that changes of the magnetic field may be detected in a time-resolved manner in a step 24. In step 25, a time-resolved magnetic field change profile may be created therefrom.

The two profiles, i.e., the acceleration profile and the magnetic field change profile, may be correlated in step 26 so that a comparison of the profile correlation to a predeterminable correlation signature may take place in step 27, for example, in a micro-processor or in a micro-controller. If the profile correlation matches the correlation signature, an alarm signal may be output in step 28, which signals the detection of a break-in or of a break-in attempt by lock picking. All common lock picking tools may be detected reliably and rapidly with this approach.

What is claimed is:

1. A sensor system for a locking system of a door, comprising:

an acceleration sensor configured to detect movements of the door in at least two dimensions;

a magnetic field sensor configured to detect a magnetic field in the area of the locking system and to detect changes of the magnetic field; and a control device coupled to the acceleration sensor and to the magnetic field sensor, wherein the control device is configured to (i) record a time-resolved acceleration profile from the detected movements of the door, (ii) record a time-resolved magnetic field change profile from the detected changes of the magnetic field, (iii) determine a profile correlation between the time-resolved acceleration profile and the time-resolved magnetic field change profile, (iv) compare the determined profile correlation to a predetermined correlation signature, and (v) output an alarm signal if the profile correlation matches the predetermined correlation signature.

2. The sensor system as recited in claim 1, wherein the control device includes one of a microcontroller or a microprocessor.

3. The sensor system as recited in claim 2, wherein the control device includes a memory area configured to store the at least one predetermined correlation signature.

4. The sensor system as recited in claim 2, further comprising:

a signal output device coupled to the control device.

5. The sensor system as recited in claim 4, wherein the signal output device is configured to output the alarm signal via an output interface to an alarm transmitter.

6. The sensor system as recited in claim 4, wherein the signal output device is configured to output the alarm signal via wireless communication to an alarm transmitter.

7. A locking arrangement for a door, comprising:

a locking system; and a sensor system including:

an acceleration sensor configured to detect movements of the door in at least two dimensions;

a magnetic field sensor configured to detect a magnetic field in the area of the locking system and to detect changes of the magnetic field; and a control device coupled to the acceleration sensor and to the magnetic field sensor, wherein the control device is configured to (i) record a time-resolved acceleration profile from the detected movements of the door, (ii) record a time-resolved magnetic field change profile from the detected changes of the magnetic field, (iii) determine a profile correlation between the time-resolved acceleration profile and the time-resolved magnetic field change profile, (iv) compare the profile correlation to a predetermined correlation signature, and (v) output an alarm signal if the profile correlation matches the predetermined correlation signature;

wherein the sensor system is situated in an internal area of the door and is configured to detect a magnetic field at an outside area of the door and to output the alarm signal in the case of an unauthorized opening attempt of the locking system.

8. A method for detecting tampering of a locking system of a door, comprising:

performing time-resolved detection of movements of the door in at least two dimensions;

recording a time-resolved acceleration profile based on the detected movements of the door;

detecting a magnetic field in the area of the locking system;

performing a time-resolved detection of changes of the magnetic field;

recording a time-resolved magnetic field change profile;

determining a profile correlation between the time-resolved acceleration profile and the time-resolved magnetic field change profile;

comparing the determined profile correlation to a predetermined correlation signature; and outputting an alarm signal if the determined profile correlation matches the predetermined correlation signature.

* * * * *